US008297085B2

(12) United States Patent
Kim et al.

(10) Patent No.: US 8,297,085 B2
(45) Date of Patent: Oct. 30, 2012

(54) WASHING MACHINE

(75) Inventors: Dongyoon Kim, Changwon-si (KR); Youngbae Park, Changwon-si (KR); Taehyeon Sim, Changwon-si (KR); Jimaeng Kim, Changwon-si (KR); Youngjong Kim, Changwon-si (KR); Hyuksoo Lee, Changwon-si (KR); Seongno Yoon, Changwon-si (KR); Younggon Kim, Changwon-si (KR); Jongdeuk Bae, Changwon-si (KR); Sunggi Hwang, Changwon-si (KR); Seogkyu Park, Changwon-si (KR)

(73) Assignee: LG Electronics Inc., Seoul (KR)

( * ) Notice: Subject to any disclaimer, the term of this patent is extended or adjusted under 35 U.S.C. 154(b) by 140 days.

(21) Appl. No.: 12/846,206

(22) Filed: Jul. 29, 2010

(65) Prior Publication Data

US 2011/0121694 A1 May 26, 2011

Related U.S. Application Data

(60) Provisional application No. 61/230,590, filed on Jul. 31, 2009, provisional application No. 61/230,510, filed on Jul. 31, 2009, provisional application No. 61/230,613, filed on Jul. 31, 2009.

(30) Foreign Application Priority Data

| | | |
|---|---|---|
| Jul. 31, 2009 | (KR) | 10-2009-0071056 |
| Jul. 31, 2009 | (KR) | 10-2009-0071057 |
| Jul. 31, 2009 | (KR) | 10-2009-0071058 |
| Oct. 20, 2009 | (KR) | 10-2009-0099899 |
| Oct. 20, 2009 | (KR) | 10-2009-0099900 |
| Oct. 20, 2009 | (KR) | 10-2009-0099901 |

(51) Int. Cl.

| | |
|---|---|
| ***D06F 17/00*** | (2006.01) |
| ***A47K 1/04*** | (2006.01) |
| ***A47B 88/00*** | (2006.01) |

(52) U.S. Cl. ..... 68/196; 312/228; 312/328

(58) Field of Classification Search ..... 312/228, 312/257.1, 327–329, 204, 138.1, 265.5; 34/603, 34/201; 68/196; 134/200; 16/415, 443; 220/212.5

See application file for complete search history.

(56) References Cited

U.S. PATENT DOCUMENTS

| | | | | |
|---|---|---|---|---|
| 4,522,311 | A * | 6/1985 | Ikeda | 220/843 |
| 4,843,519 | A * | 6/1989 | Lehr | 361/641 |
| 6,102,504 | A * | 8/2000 | Richardson | 312/328 |

(Continued)

FOREIGN PATENT DOCUMENTS

WO WO 2009116752 A2 * 9/2009

*Primary Examiner* — David Dunn
*Assistant Examiner* — Ryan A Doyle
(74) *Attorney, Agent, or Firm* — Birch, Stewart, Kolasch & Birch, LLP

(57) ABSTRACT

A washing machine comprising a cabinet, a top cover arranged at an upper surface of the cabinet and has a laundry entrance hole, wherein the upper surface of the cabinet opens, and a lid assembly arranged at the top cover and opens/closes the laundry entrance hole is provided. A handle is provided at a front side of the lid assembly. The handle protrudes forwards more than the top cover, wherein the handle and the top cover are arranged to be spaced apart from each other in upper and lower directions and in front and rear directions, thereby defining spaces between the handle and the top cover so a user's hand is inserted into the spaces to hold the handle and lifts the lid assembly.

14 Claims, 21 Drawing Sheets

U.S. PATENT DOCUMENTS

| | | | | |
|---|---|---|---|---|
| 6,216,498 | B1 * | 4/2001 | Wright et al. | 68/3 R |
| 6,282,927 | B1 * | 9/2001 | Wunderlich et al. | 68/3 R |
| D489,496 | S * | 5/2004 | Sneddon | D32/6 |
| 7,032,350 | B2 * | 4/2006 | Bienick et al. | 49/501 |
| 7,275,346 | B2 * | 10/2007 | Bienick et al. | 49/501 |
| 7,320,186 | B2 * | 1/2008 | Schone | 34/603 |
| 7,513,131 | B2 * | 4/2009 | Kim | 68/13 R |
| 2004/0123490 | A1 * | 7/2004 | Pancheri et al. | 34/597 |
| 2004/0231370 | A1 * | 11/2004 | Cheo et al. | 68/3 R |
| 2005/0050925 | A1 * | 3/2005 | Je et al. | 68/3 R |
| 2005/0179347 | A1 * | 8/2005 | Kim et al. | 312/228 |
| 2006/0090523 | A1 * | 5/2006 | Lyu | 68/3 R |
| 2007/0180868 | A1 * | 8/2007 | Hur | 68/3 R |
| 2009/0229320 | A1 * | 9/2009 | Yoo et al. | 68/3 R |

* cited by examiner

WASHING MACHINE

CROSS-REFERENCE TO RELATED APPLICATION

This application claims priority to Korean Patent Application No. 10-2009-0071056 filed on Jul. 31, 2009 and No. 10-2009-0071057 filed on Jul. 31, 2009 and No. 10-2009-0071058 filed on Jul. 31, 2009 and No. 10-2009-99901 filed on Oct. 20, 2009 and No. 10-2009-99899 filed on Oct. 20, 2009 and No. 10-2009-99900 filed on Oct. 20, 2009, in the Korean Intellectual Property Office, and U.S. Provisional Patent Application No. 61/230,590, 61/230,510 and 61/230,613 filed on Jul. 31, 2009 in the USPTO, the contents of which are herein incorporated by reference in its entirety.

BACKGROUND OF THE INVENTION

1. Technical Field

This disclosure is directed to a washing machine, and more specifically, to a washing machine with a lid assembly which may be more securely assembled and provide stability and convenience of use.

2. Discussion of Related Art

In general, a washing machine may include a laundry washer that gets rid of contaminants from clothing or bedding (hereinafter, referred to as "laundry") using a chemical action between water and detergent and a mechanical action, and a dryer which dries wet laundry using air heated by a heater and a mechanical action. Also, a washing machine may have both a washing function and a drying function. Further, a washing machine may also include a refresher which sprays hot steam to laundry to prevent allergies. A washing machine may include various devices which exert physical or chemical actions to laundry to clean the laundry.

Washing machines may be categorized based on the location of a laundry entrance hole. For example, top load type washing machine have a laundry entrance hole at an upper surface of a cabinet and wash the laundry by a rotational water current generated when a washing tub rotates. Drum type washing machines have a laundry entrance hole at a front surface of a cabinet and wash the laundry by dropping the laundry in a drum while rotating the drum.

A lid assembly is arranged at an upper side of the cabinet of a top load type washing machine to open and close the laundry entrance hole.

SUMMARY OF THE INVENTION

Exemplary embodiments of the present invention provide a washing machine with a lid assembly which may provide aesthetic appearance, stability, and convenience of use.

According to an embodiment, there is provided a washing machine comprising: a cabinet; a top cover which is arranged at an open top surface of the cabinet and has a laundry entrance hole; and a lid assembly which is arranged at the top cover and opens/closes the laundry entrance hole, wherein a handle is provided at a front side of the lid assembly and is protruded forwards more than the top cover, and the handle and the top cover are arranged to be spaced apart from each other in upper and lower directions and in front and rear directions, thereby defining spaces between the handle and the top cover so a user's hand is inserted into the spaces to hold the handle and lifts the lid assembly.

According to an embodiment, a step part is provided at a front portion of the top cover to be spaced apart from the handle by a predetermined interval.

According to an embodiment, the step part includes a first rounded part which faces a user's fingertip inserted toward the step part and is bent upwards with a predetermined curvature, and a second rounded part which is extended upwards from the first rounded part and bent rearwards with a predetermined curvature.

According to an embodiment, a portion where a front surface portion of the top cover and the step part meet is rounded with a predetermined curvature.

According to an embodiment, the lid assembly includes a lid frame which forms the appearance, a lid inner coupled to an interior of the lid frame and has a hinge unit, and a decoration panel coupled to a front side of the lid frame, wherein the handle is a lower portion of a combined part that a front portion of the lid frame and a front portion of the decoration panel are combined.

According to an embodiment, the lid frame includes an upper lid frame which forms an upper portion of the lid frame and supports the lid inner, and a lower lid frame which is coupled to a lower side of the upper lid frame and forms a lower portion of the lid frame, wherein the handle is a lower portion of a combined part that a front portion of the lower lid frame and a front portion of the decoration panel are combined.

According to an embodiment, a thickness of a lower portion of the handle ranges from 15 mm to 17 mm in front and rear directions.

According to an embodiment, a lower portion of the handle has a protrusion which protrudes towards the top cover.

According to an embodiment, the decoration panel covers part of a front upper surface of the upper lid frame and is hooked and coupled to a front lower portion of the lower lid frame.

According to an embodiment, a front portion of the upper lid frame is formed to be inclined by a predetermined angle, wherein the decoration panel is formed to be inclined to correspond to the upper lid frame, wherein a front lower portion of the decoration panel is rounded.

According to an embodiment, a lower end of the decoration panel is arranged to be lower than a front end of the lower lid frame to cover the front end of the lower lid frame.

According to an embodiment, the decoration panel slides and coupled to a front upper surface of the upper lid frame.

According to an embodiment, the decoration panel includes an upper connecting protrusion which protrudes towards an upper surface of the upper lid frame to be coupled to the upper lid frame, and a lower connecting protrusion which protrudes towards the lower lid frame to be coupled to the lower lid frame.

According to an embodiment, the upper lid frame includes an upper connecting protrusion coupling hole to which the upper connecting protrusion is inserted and slides and is hooked, and the lower lid frame includes a lower connecting protrusion coupling hole to which the lower connecting protrusion is inserted.

According to an embodiment, the upper connecting protrusion protrudes towards the upper lid frame from the decoration panel and then is bent to be shaped as a hook.

According to an embodiment, the lower connecting protrusion protrudes upwards from a lower portion of an inner surface of the decoration panel to be press-fittingly coupled to the lower lid frame in upper and lower directions.

According to an embodiment, the upper connecting protrusion coupling hole includes an inserting hole to which the upper connecting protrusion is inserted, and a hooked part extended from the inserting hole and guides a sliding movement of the upper connecting protrusion and has a width narrower than the inserting part so that the upper connecting protrusion is hooked to the hooked part.

According to an embodiment, the decoration panel includes a guide protrusion which protrudes towards an upper surface of the upper lid frame and guides an assembling position, and the upper lid frame includes a guide protrusion coupling hole to which the guide protrusion is coupled.

According to an embodiment, there is provided a washing machine comprising: a top cover having a laundry entrance hole; a lid assembly arranged to be able to rotate at an upper side of the top cover and opens/closes the laundry entrance hole, wherein the lid assembly includes an upper lid frame forming an upper portion of the lid frame, a lower lid frame forming a lower portion of the lid frame, and a decoration panel including an upper portion which slides and is coupled to a front upper side of the upper lid frame and a lower portion coupled to the lower lid frame.

According to an embodiment, there is provided a washing machine comprising: a cabinet having a laundry entrance hole at an upper side; and a lid assembly is arranged to be able to rotate at an upper side of the cabinet and opens/closes the laundry entrance hole, wherein the lid assembly includes an upper lid frame forming an upper portion of the lid frame, a lower lid frame forming a lower portion of the lid frame, and a decoration panel coupled to a front portion of the upper lid frame and the lower lid frame to define a handle and covers one part of a front end of the lower lid frame.

In the washing machine according to an embodiment of the present invention, the handle is provided at a front lower portion of the lid assembly so that a user may hold the handle. A space is provided between the handle and the top cover so that the user's hand may be inserted into the space to hold the handle and lift the lid assembly. Accordingly, it is not necessary to separately add a handle to the exterior of the lid assembly or form a groove which replaces the handle. This simplifies the structure of the lid assembly, thus preventing dirt or dust from being attached to the surface of the lid assembly and providing a beautiful appearance.

Further, the space between the lid assembly and the top cover functions as a groove for handle, and this allows a user to easily hold and lift the lid assembly. Accordingly, convenience of use may be provided.

Further, since the front portion of the top cover is rounded, it can prevent that user's fingertips or fingernails are damaged when the user's hand is inserted. Accordingly, stability may be provided.

Further, the washing machine according to an embodiment of the present invention includes an upper lid frame, a lower lid frame, and a decoration panel which slides and then is coupled to the front portion of the lid frame. Accordingly, the lid frame may be easily assembled.

Further, the decoration panel covers a gap between the upper and lower lid frames. This may provide an aesthetic beautiful appearance.

DETAILED DESCRIPTION

Hereinafter, exemplary embodiments of a top load type washing machine (hereinafter, referred to as "washing machine") will be described in greater detail with reference to the accompanying drawings.

Figure 1:
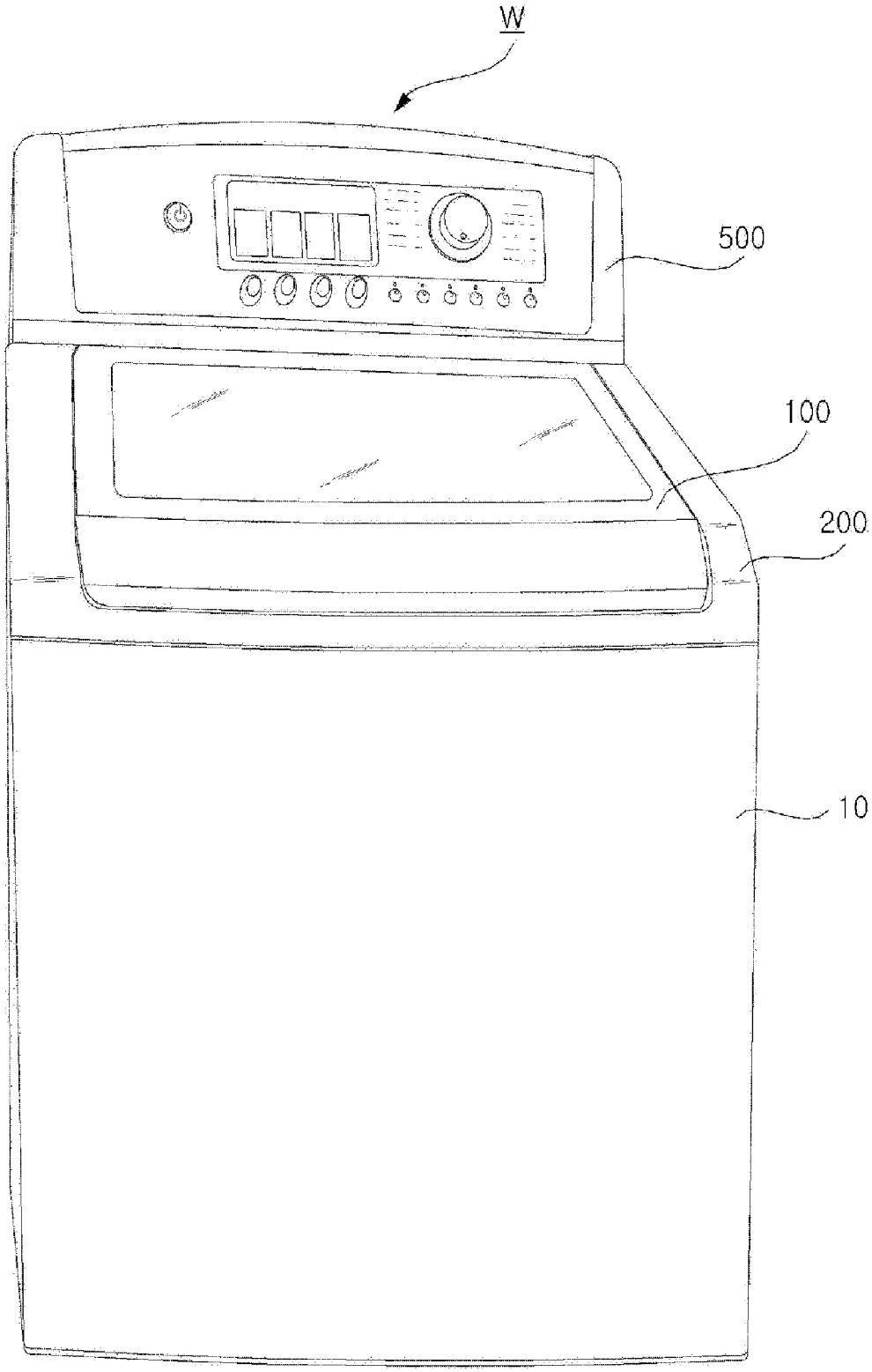
FIG. 1 is a perspective view illustrating a washing machine according to an embodiment of the present invention.
Figure 2:
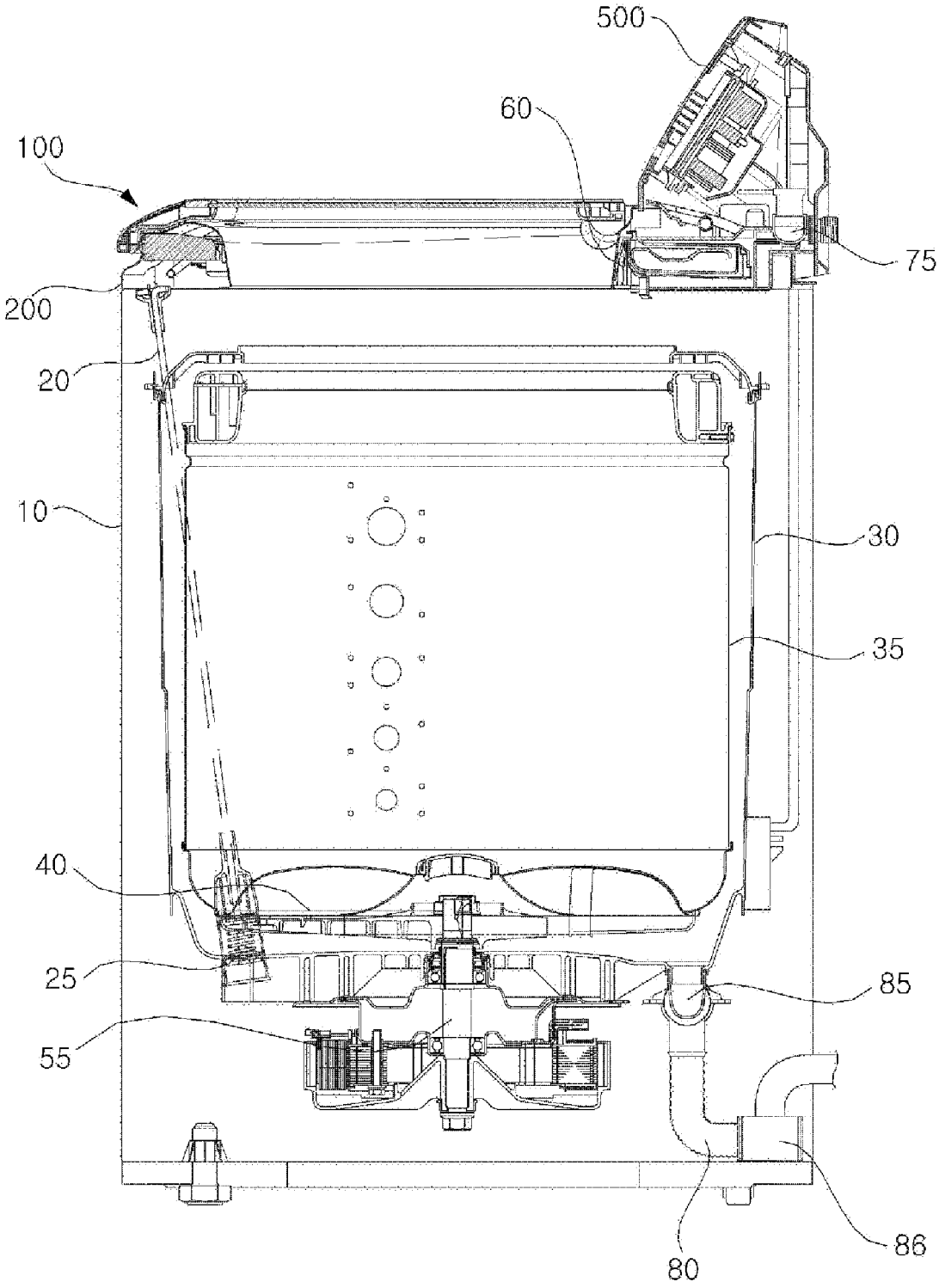
FIG. 2 is a cross sectional view of the washing machine shown in FIG. 1.

FIG. 1 is a perspective view illustrating a washing machine according to an embodiment of the present invention and FIG. 2 is a cross sectional view of the washing machine shown in FIG. 1.

Referring to FIGS. 1 and 2, the washing machine W includes a cabinet 10, a top cover 200, a lid assembly 100, and a control panel 500. The top cover 200 is arranged at an upper side of the cabinet 10 and includes a laundry entrance hole 211*h*. The lid assembly 100 is rotatably connected with the top cover 200 to open and close the laundry entrance hole 211*h*. The control panel 500 allows a user to control the washing machine W.

Referring to FIG. 2, an outer tub 30 is supported by a support member 20 inside the cabinet 10. An inner tub 35 for containing laundry is rotatably arranged inside the outer tub 30.

An upper end of the support member 20 is connected to the top cover 200 or an upper side of the cabinet 10. A damper 25 connected to a lower portion of the outer tub 30 is provided at a lower end of the support member 20.

A plurality of pores is provided along the circumferential surface of the inner tub 35. A pulsator 40 is positioned at the bottom surface of the inner tub 35 to generate rotational water current.

A motor 55 is positioned at a lower portion of the outer tub 30 to rotate the inner tub 35 and the pulsator 40. The motor 55 is connected to the inner tub 35 via a rotational shaft to rotate the inner tub 35. A clutch (not shown) is positioned between the inner tub 35 and the pulsator 40 to selectively transfer a rotational force to at least one of the inner tub 35 and the pulsator 40. By the clutch, either or both of the inner tub 35 and the pulsator 40 may be rotated.

A detergent box is positioned at the top cover 200 to receive a detergent.

The washing machine W further includes a water supply hose 75 which guides water from an external tab (not shown) to the detergent box 60 and a water supply valve (not shown) which opens/closes washing water passing through the water supply hose 75.

The washing machine W further includes a drainage hose 80 connected to a lower portion of the outer tub 30 to guide washing water from the outer tub 30 to the outside, a drainage pump 86 which pumps washing water in the outer tub 30, and a drainage valve 85 which opens/closes washing water discharged through the drainage hose 80 to the outside.

Figure 3:
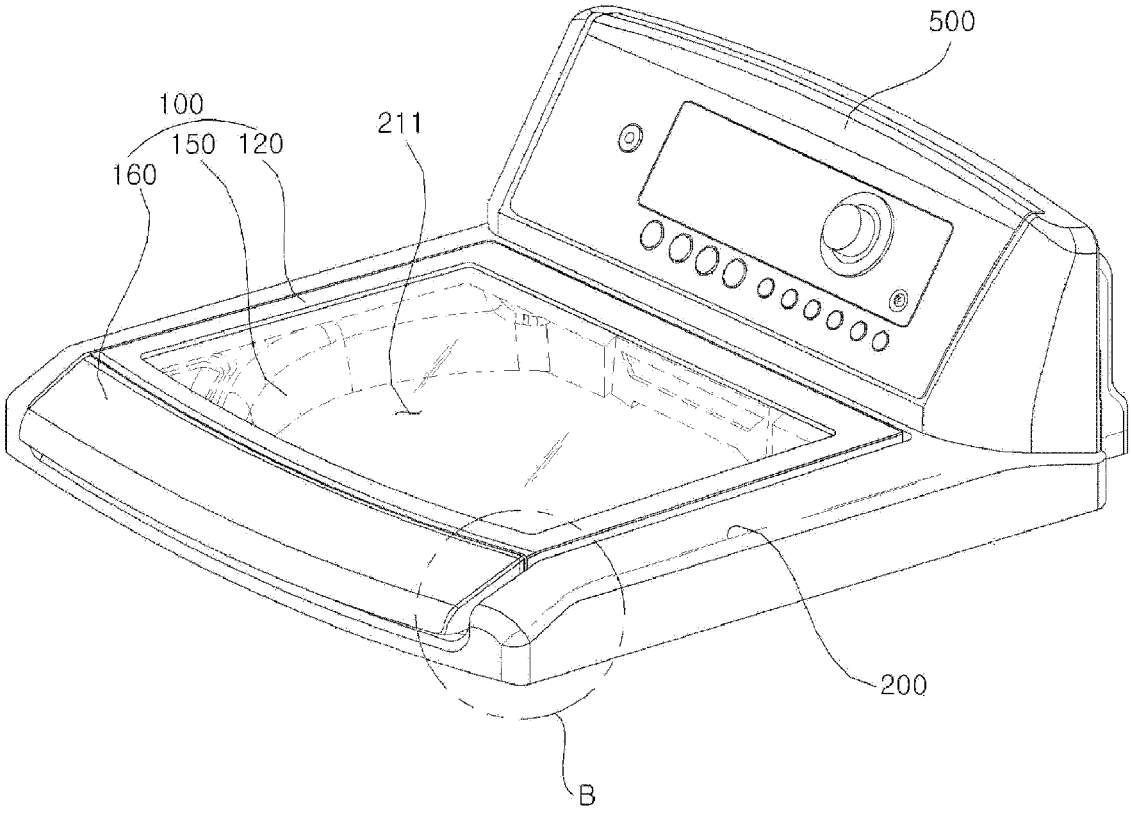
FIG. 3 is a perspective view illustrating the top cover and the lid assembly shown in FIG. 1.
Figure 4:
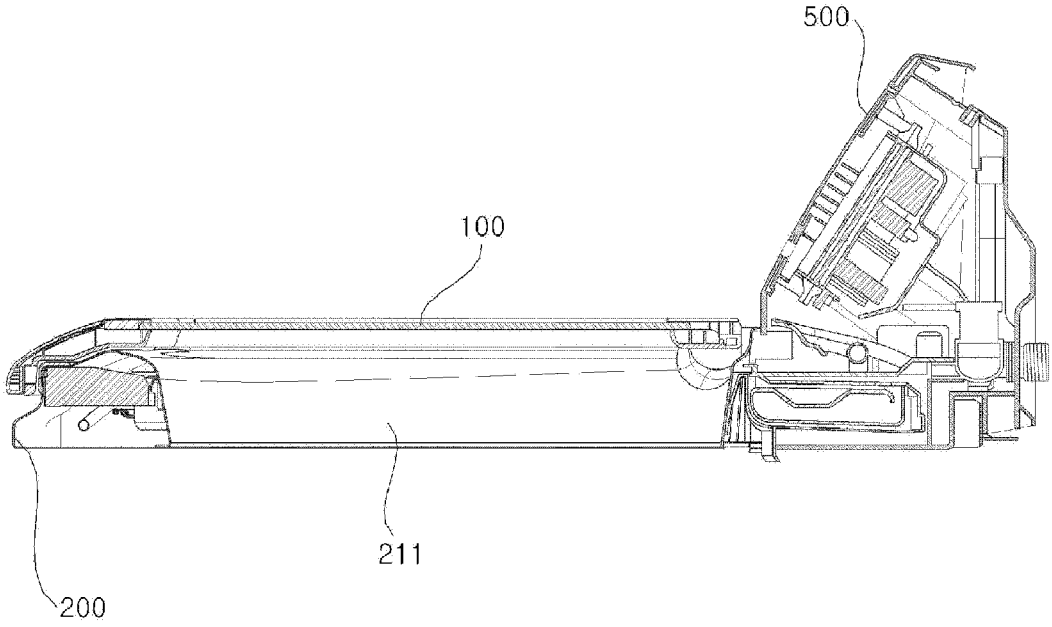
FIG. 4 is a cross sectional view of FIG. 3.
Figure 5:
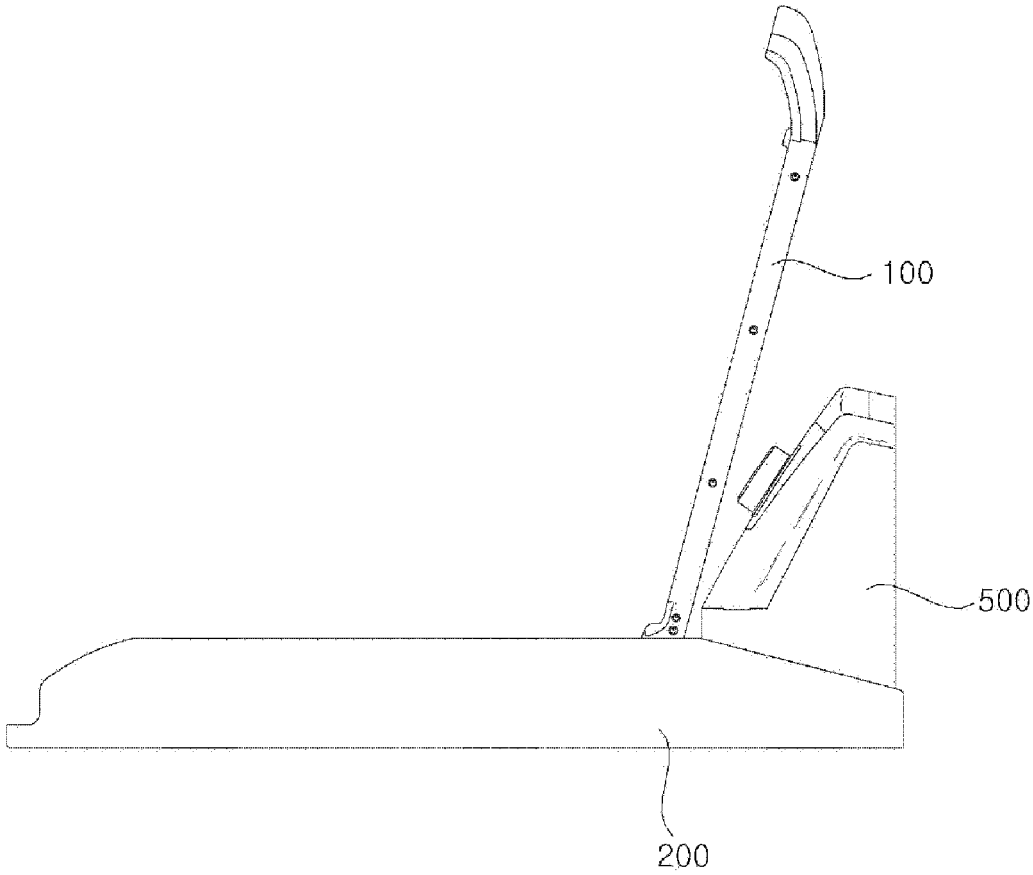
FIG. 5 is a side view of FIG. 3 wherein the lid assembly is left open.

FIG. 3 is a perspective view illustrating the top cover and the lid assembly shown in FIG. 1, FIG. 4 is a cross sectional view of FIG. 3, and FIG. 5 is a side view of FIG. 3 wherein the lid assembly is left open.

Referring to FIGS. 3 to 5, the lid assembly 100 is rotatably connected to the top cover 200 to open/close the laundry entrance hole 211*h*. The lid assembly 100 may be rotatably connected to the top cover 200 by a hinge unit 300 which will be described below.

Figure 6:
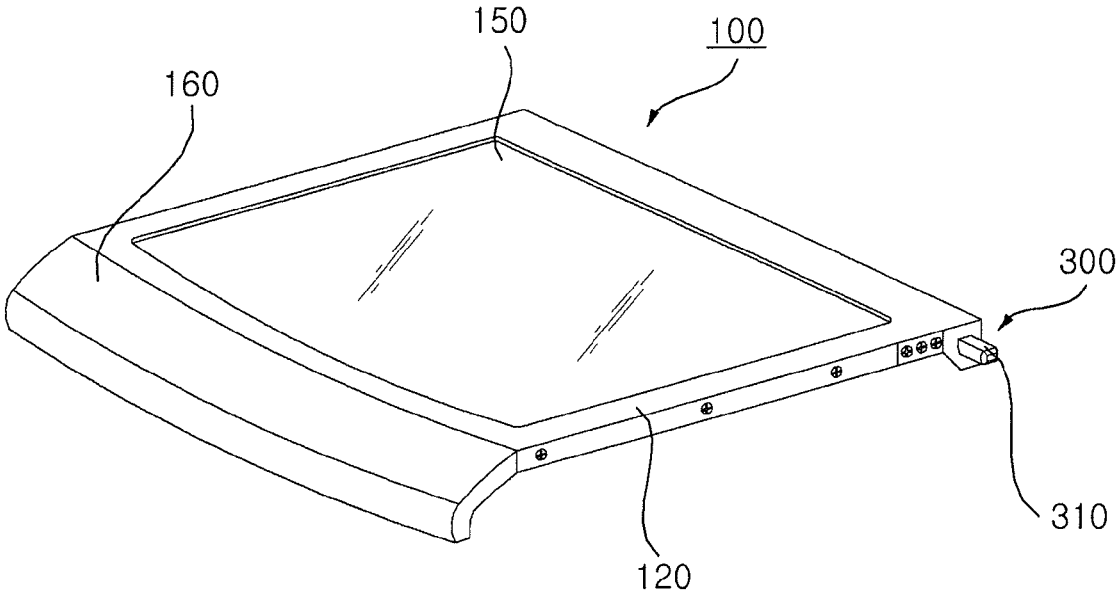
FIG. 6 is a perspective view illustrating the lid assembly shown in FIG. 3.
Figure 7:
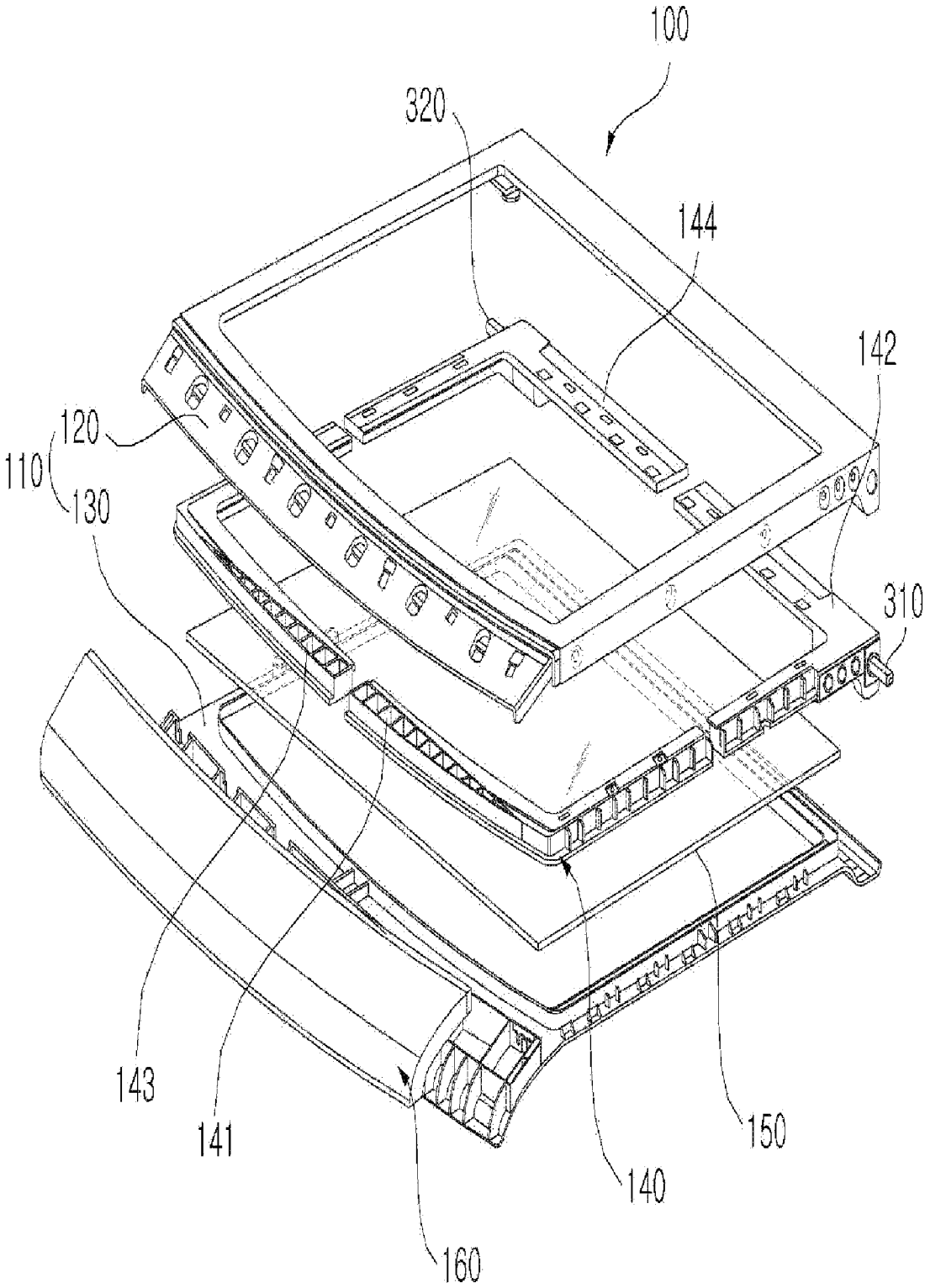
FIG. 7 is an exploded perspective view illustrating the lid assembly shown in FIG. 6.

FIG. 6 is a perspective view illustrating the lid assembly shown in FIG. 3 and FIG. 7 is an exploded perspective view illustrating the lid assembly shown in FIG. 6.

Referring to FIGS. 6 and 7, the lid assembly 100 includes a lid frame 110 which forms the appearance of the lid assembly 100, a lid inner 140 connected to the lid frame 110 at the inside of the lid frame 110 and has a hinge unit 300, a glass unit 150 positioned at a portion where the lid frame 110 and the lid inner 140 are open, and a decoration panel 160 connected to the lid frame 110 at a front portion of the lid frame 110.

Referring to FIG. 7, the lid frame 110 includes an upper lid frame 120 which forms the appearance of an upper portion of the lid frame 110 and a lower lid frame 130 which forms the appearance of a lower portion of the lid frame 110 and is connected to a lower side of the upper lid frame 120.

A plurality of lid inners 140 may be positioned to be spaced apart from each other by a predetermined interval. For purposes of brevity, it is assumed that four lid inners 140 are provided. However, the present invention is not limited thereto. For example, at least two or more lid inners 140 may be provided.

Each of the four lid inners 140 may have the similar shape to that of a corner of the lid frame 110. Two lid inners 140 are arranged at each side of the lid frame 110. For example, the lid inners 140 may include first, second, third, and fourth lid inners 141, 142, 143, and 144, wherein the first and third lid inners 141 and 143 may be arranged at a front side, and the second and fourth lid inners 142 and 144 may be arranged at a rear side. The hinge unit 300 may be coupled to each of the second and fourth lid inners 142 and 144.

At least one hinge unit 300 may be provided. An embodiment will be described where the hinge unit 300 includes a first hinge unit 310 coupled to the second lid inner 142 and a second hinge unit 320 coupled to the fourth lid inner 144. The hinge unit 300 will be described in greater detail later.

Figure 8:
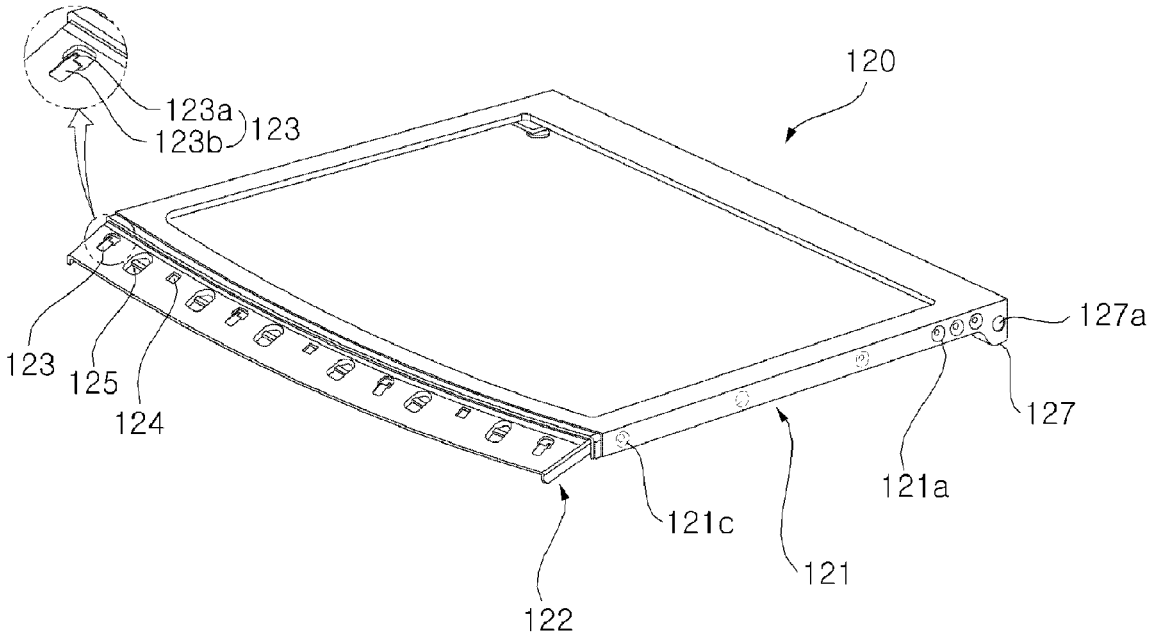
FIG. 8 is a perspective view illustrating an upper surface of the upper lid frame shown in FIG. 7.
Figure 9:
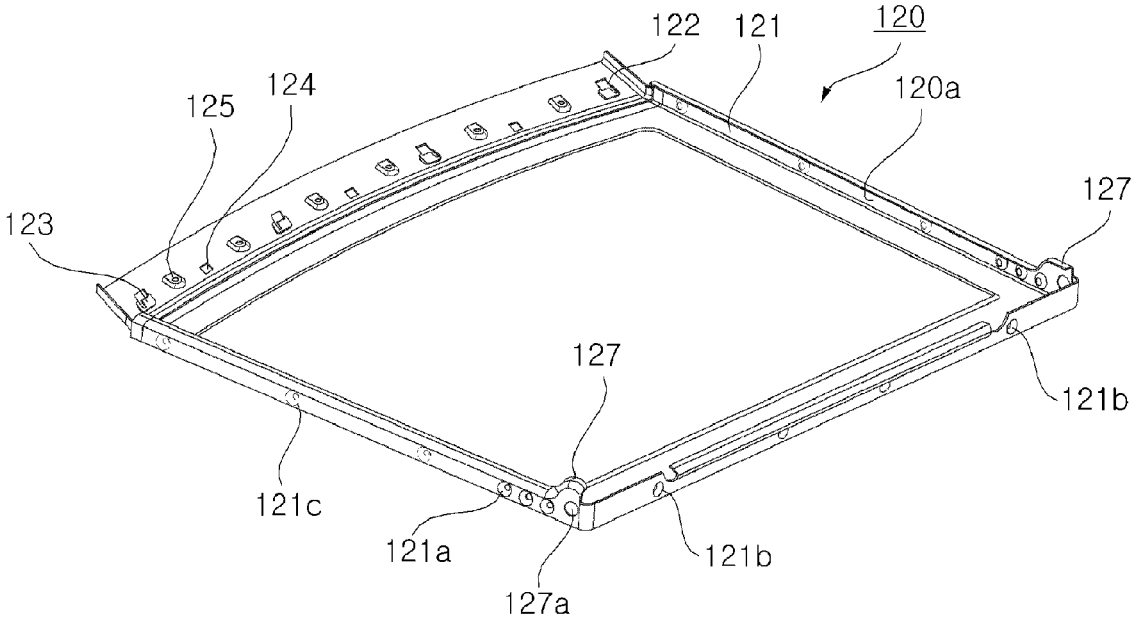
FIG. 9 is a perspective view illustrating a lower surface of the upper lid frame shown in FIG. 8.

FIG. 8 is a perspective view illustrating an upper surface of the upper lid frame shown in FIG. 7, and FIG. 9 is a perspective view illustrating a lower surface of the upper lid frame shown in FIG. 8.

Referring to FIGS. 8 and 9, the upper lid frame 120 has an opening at its central portion. The glass unit 150 is arranged at the opening.

The upper lid frame 120 includes a rectangular frame part 121 which has an opening at its central portion and a coupling part 122 which extends from a front end of the frame part 121 and is coupled to the lower lid frame 130.

The coupling part 122 of the upper lid frame 120 is formed to be inclined downwards from the frame part 121 by a predetermined angle.

The decoration panel 160 is coupled to an upper side of the coupling part 122 of the upper lid frame 120, and the lower lid frame 130 is coupled to a lower side of the coupling part 122 of the upper lid frame 120.

Referring to FIG. 8, the coupling part 122 of the upper lid frame 120 includes an upper connecting protrusion coupling hole 123 to which an upper connecting protrusion 161 (refer to FIG. 18) is connected, a guide protrusion coupling hole 124 to which a guide protrusion 162 (refer to FIG. 16) is connected, and a screw connecting hole 125 connected to the lower lid frame 130 via a connecting member, such as a screw. The upper connecting protrusion 161 and the guide protrusion 162 are formed on the decoration panel 160. The connecting protrusion 161 and the guide protrusion 162 will be described below.

The guide protrusion 162 (refer to FIG. 16) is inserted into the guide protrusion coupling hole 124 in upper and lower directions to guide and position the decoration panel 160 upon assembly of the decoration panel 160. For example, the guide protrusion coupling hole 124 may be shaped to correspond to the shape of the guide protrusion 162 which will be described below.

The upper connecting protrusion 161 is inserted into the upper connecting protrusion coupling hole 123 and slides and then connected to the upper connecting protrusion coupling hole 123. By doing so, the decoration panel 160 may slide and then is connected to the upper lid frame 120.

The upper connecting protrusion 161 (refer to FIG. 18) protrudes toward the upper lid frame 120 and then is bent downwards, and is thereby shaped as a hook.

The upper connecting protrusion coupling hole 123 includes an inserting part 123*a* into which the upper connecting protrusion 161 is inserted and a hooked part 123*b* which extends from the inserting part 123*a* with a reduced width in left and right directions. Accordingly, the connecting protrusion 161 may be hooked to the hooked part 123*b*.

Since the decoration panel 160 is positioned over the coupling part 122 of the upper lid frame 120, the upper connecting protrusion coupling hole 123, the guide protrusion coupling hole 124, and the screw connecting hole 125 may be covered by the decoration panel 160.

The left and right side surfaces and the rear surface of the frame part 121 may be coupled to the lower lid frame 130. An embodiment will be described where each of the left and right side surfaces and rear surface of the frame part 121 is coupled via a connecting member, such as a screw, to the lower lid frame 130 connected with the hinge unit 300.

The frame part 121 of the upper lid frame 120, the hinge unit 300, and the lid inner 140 may be integrally connected to each other by a screw. The frame part 121 of the upper lid frame 120 and the lid inner 140 may be only connected to each other by a screw. A side screw coupling hole 121*a* is formed at each of the left and right side surfaces of the frame part 121 for the screw connection. A plurality of side screw coupling holes 121*a* may be provided. The side screw coupling hole 121*a* may be positioned at a location close to the hinge unit 300.

Referring to FIG. 9, a rear screw coupling hole 121*b* is provided at the rear surface of the frame part 121 for screw connection. Two rear screw coupling holes 121*b* may be provided, each of which may be positioned at a location close to the hinge unit 300. Because of being positioned at a location where the hinge unit 300 is connected, the side screw coupling hole 121*a* and the rear screw coupling hole 121*b* may effectively support the hinge unit 300.

Each of the left and right side surfaces of the upper lid frame 120 may be connected to the lid inner 140 via a connecting member, such as a screw. The screw connecting hole 121*c* may be formed at the left and right side surfaces of the upper lid frame 120.

Referring to FIGS. 8 and 9, the upper lid frame 120 includes a hinge cover 127 which covers the hinge unit 300.

The hinge cover 127 is extended downwards from each of the left and right side surfaces of the upper lid frame 120. The hinge cover 127 has a through-hole 127*a* for the hinge shaft of the hinge unit 300 to pass therethrough.

Referring to FIG. 9, a lid inner inserting groove 120*a* is formed at each of the left and right side surfaces of the upper lid frame 120 so that the lid inner 140 may be seated on the lid inner inserting groove 120*a*. The lid inner inserting groove 120*a* may have a cross section shaped as the symbol "[".

The upper lid frame 120 may be made of a metallic material or an elastic material. An embodiment will be described where the upper lid frame 120 is made of steel with rigidity.

Figure 10:
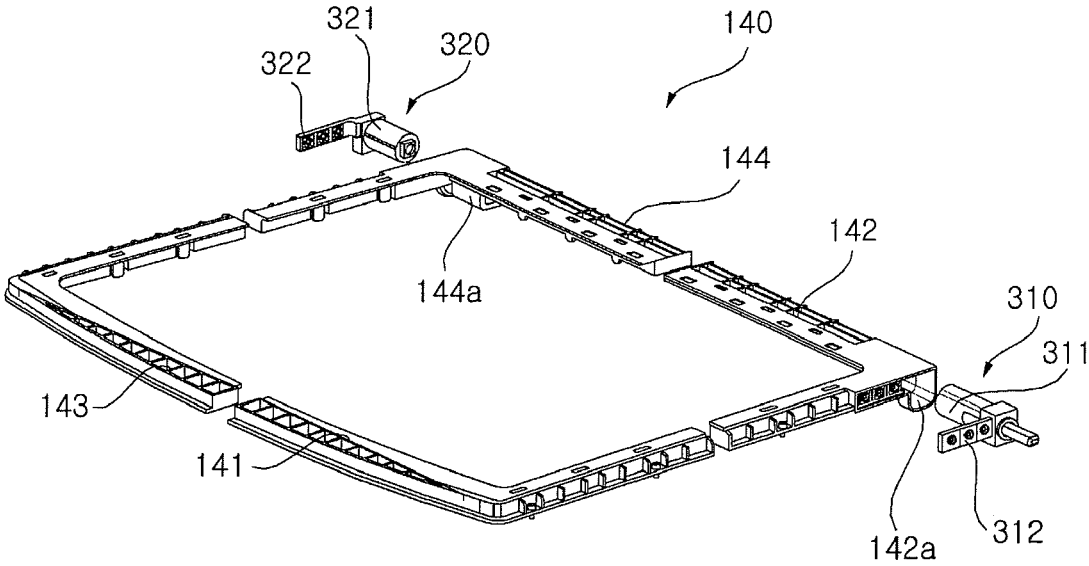
FIG. 10 is an exploded perspective view illustrating lid inners and hinge units dissembled from each other.
Figure 11:
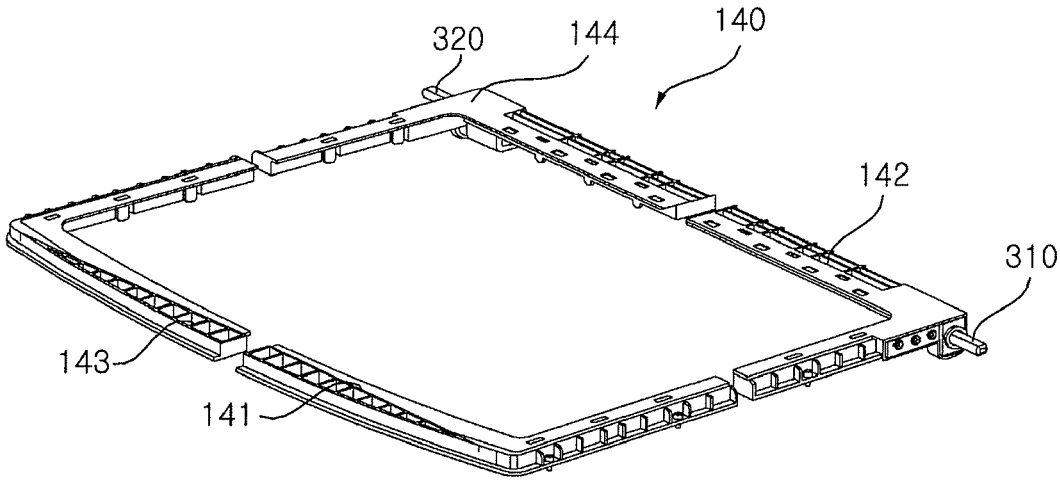
FIG. 11 is a perspective view illustrating lid inners and hinge units assembled to each other.
Figure 12:
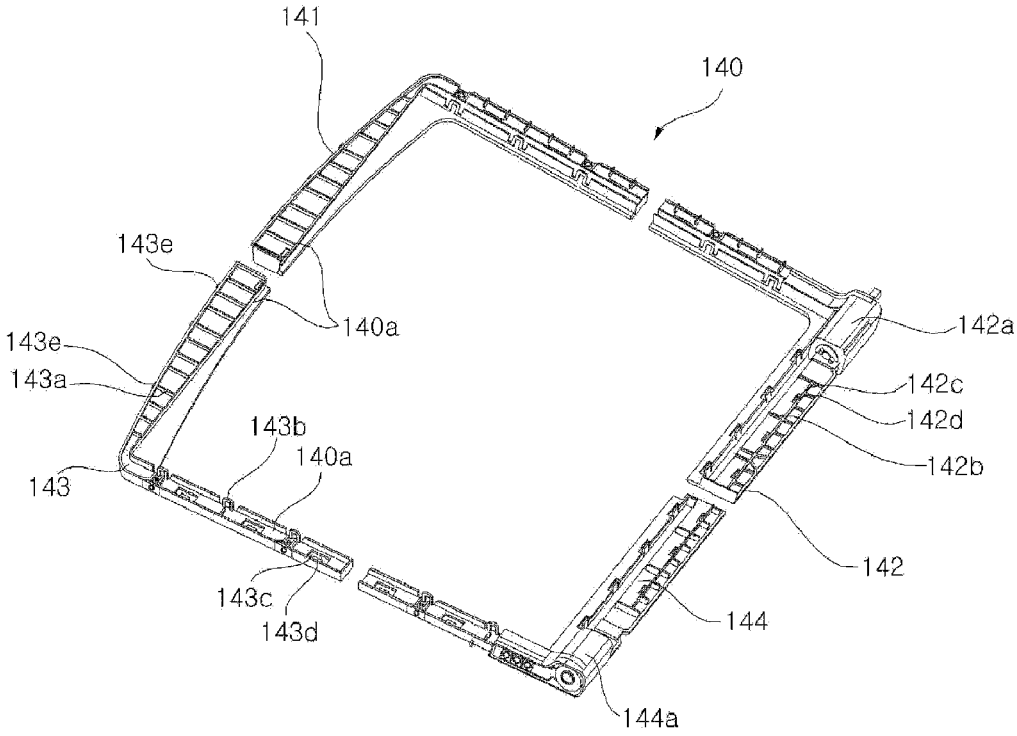
FIG. 12 is a perspective view illustrating a bottom surface of the lid inners shown in FIG. 11.

FIG. 10 is an exploded perspective view illustrating lid inners and hinge units dissembled from each other, FIG. 11 is a perspective view illustrating lid inners and hinge units assembled to each other, and FIG. 12 is a perspective view illustrating a bottom surface of the lid inners shown in FIG. 11.

As described above, the plurality of lid inners 140 include the first and third lid inners 141 and 143 positioned at a front side and the second and fourth lid inners 142 and 144 positioned at a rear side and having the hinge unit 300.

Each of the first, second, third, and fourth lid inners 141, 142, 143, and 144 is shaped as the symbol "┐"and positioned near a corner. Further, the first, second, third, and fourth lid inners 141, 142, 143, and 144 are spaced apart from each other by a predetermined interval. Specifically, an end of each of the first, second, third, and fourth lid inners 141, 142, 143, and 144 is spaced apart from an end of a neighboring lid inner of the first, second, third, and fourth lid inners 141, 142, 143, and 144. This prevents the lid inners from colliding with each other even when the lid inners are deformed due to heat.

The second lid inner 142 includes a first hinge unit receiving part 142*a* to which the first hinge unit 310 is inserted.

The fourth lid inner 144 includes a second hinge unit receiving part 144*a* to which the second hinge unit 320 is inserted.

Although the first and second hinge unit receiving parts 142*a* and 144*a* are described to be provided in the second and fourth lid inners 142 and 144, the present invention is not limited thereto. For example, the first and second hinge unit receiving parts 142*a* and 144*a* may also be formed by coupling the second and fourth lid inners 142 and 144 with the lower lid frame 130.

The first and second hinge units 310 and 320 are inserted in the axial direction into the first and second hinge unit receiving parts 142*a* and 144*a*, respectively.

The first and second hinge units 310 and 320 include hinge housings 311 and 321, respectively, and connecting arms 312 and 322, respectively. The hinge housings 311 and 321 are inserted to the second and fourth lid inners 142 and 144, respectively, and wrap around the hinge shaft. The connecting arms 312 and 322 protrude from side surfaces of the hinge housings 311 and 321, respectively, and fit into side surfaces of the second and fourth lid inners 142 and 144, respectively.

The connecting arms 312 and 322 of the first and second hinge units 310 and 320 may be integrally connected to the lid inner 140 and the lid frame 110, or may be connected only to the lid inner 140.

The first and second hinge units 310 and 320 may have the same or different functions. An embodiment will be described where the first hinge unit 310 adjusts the degree of rotation of the lid assembly 100 when the lid assembly 100 is opened or closed and the second hinge unit 320 reduces the rotation speed of the lid assembly 100 when the lid assembly 100 is opened or closed to alleviate shock.

For example, the first hinge unit 310 may include a hydraulic damper filled with a fluid to adjust the rotation speed by fluid pressure.

The second hinge unit 320 includes an elastic member which provides an elastic force in the direction which opens the lid assembly 100.

However, the present invention is not limited to the above-mentioned hinge units. The hinge unit may also include various devices or parts which may control the rotation angle or rotation speed.

Referring to FIG. 12, a plurality of ribs are provided at a lower surface of the first, second, third, and fourth lid inners 141, 142, 143, and 144.

A glass guide rib 140*a* protrudes from a lower surface of each of the first, second, third, and fourth lid inners 141, 142, 143, and 144 to seat the glass unit 150 thereon.

The glass guide rib 140*a* guides and positions the glass unit 150 upon assembly of the glass unit 150. The protruded glass guide rib 140*a* may also be formed in the bent shape, for example, in the shape of "┐".

The first lid inner 141 and the third lid inner 143 are formed symmetrical to each other, and for purposes of brevity, the description will focus on the third lid inner 143.

A first reinforcing rib 143*a* is formed on a lower surface of the third lid inner 143 to reinforce intensity. The first reinforcing rib 143*a* is longitudinally formed in the front and rear directions. A plurality of first reinforcing ribs 143*a* may be provided in the left and right directions and be spaced apart from each other by a predetermined interval. The first reinforcing rib 143*a* may prevent the third lid inner 143 from being deformed due to a force exerted by the glass unit 150 to the third lid inner 143 when the glass unit 150 is assembled.

An inner downward rib 143*b* protrudes downwards from a lower surface of the third lid inner 143 to be coupled to the lower lid frame 130. A coupling hole 143*c* is also formed on the lower surface of the third lid inner 143 to be coupled to the lower lid frame 130.

Figure 13:
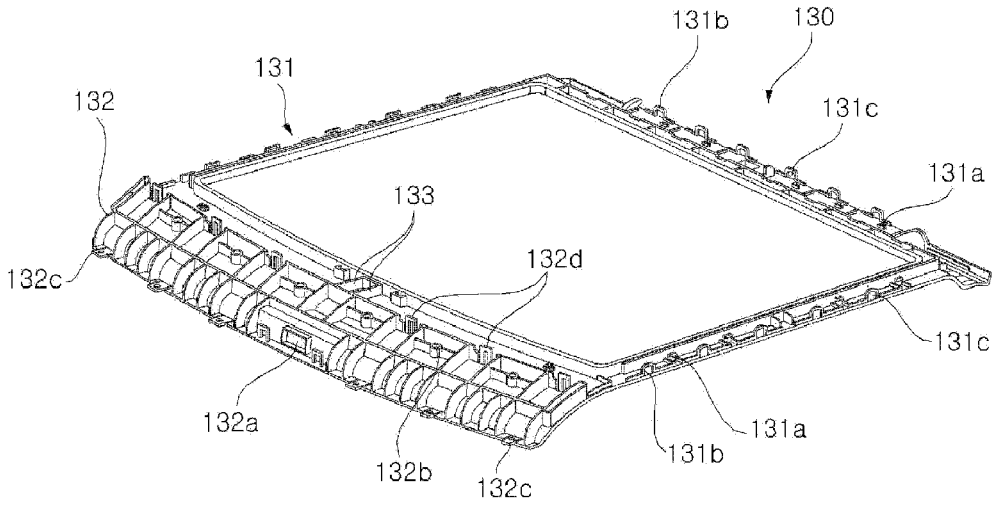
FIG. 13 is a perspective view illustrating the lower lid frame shown in FIG. 3.

Specifically, the inner downward rib 143*b* is coupled to an inner downward rib coupling part 131*a* provided in the lower lid frame 130 as shown in FIG. 13. The inner downward rib coupling part will be described below.

The coupling hole 143*c* is coupled to a frame rib 131*b* provided on the lower lid frame 130 as shown in FIG. 13. The frame rib 131*b* is inserted into the coupling hole 143*c*. A protrusion 143*d* protrudes from a side surface of the coupling hole 143*c* to hook the inserted frame rib 131*b*.

A plurality of inner front protrusions 143*e* spaced apart from each other by a predetermined interval may protrude frontward from a front surface of the third lid inner. The inner front protrusion 143*e* is coupled to a front protrusion coupling rib 132*d* provided in the lower lid frame 130. The front protrusion coupling rib 132*d* will be described below.

The second lid inner 142 and the fourth lid inner 144 may be formed symmetrical to each other. Accordingly, the description will now focus on the second lid inner 142 for purposes of brevity.

A second reinforcing rib 142*b* is formed on a lower surface of the second lid inner 142 to reinforce intensity. The second reinforcing rib 142*b* is longitudinally formed long in the front and rear directions. A plurality of second reinforcing ribs 142*b* may be provided in the left and right directions to be spaced apart from each other by a predetermined interval. The second reinforcing rib 142*b* may prevent the second lid inner 142 from being deformed due to a force exerted by the glass unit 150 to the second lid inner 142 when the glass unit 150 is assembled.

A coupling hole 142*c* is formed on a lower surface of the second lid inner 142 to be coupled to a frame rib 131*c* provided on the lower lid frame 130 as shown in FIG. 13. The frame rib 131*b* may be inserted into the coupling hole 142*c*. A protrusion 142*d* protrudes from a side surface of the coupling hole 142*c* to hook the inserted frame rib 131*b*.

Figure 14:
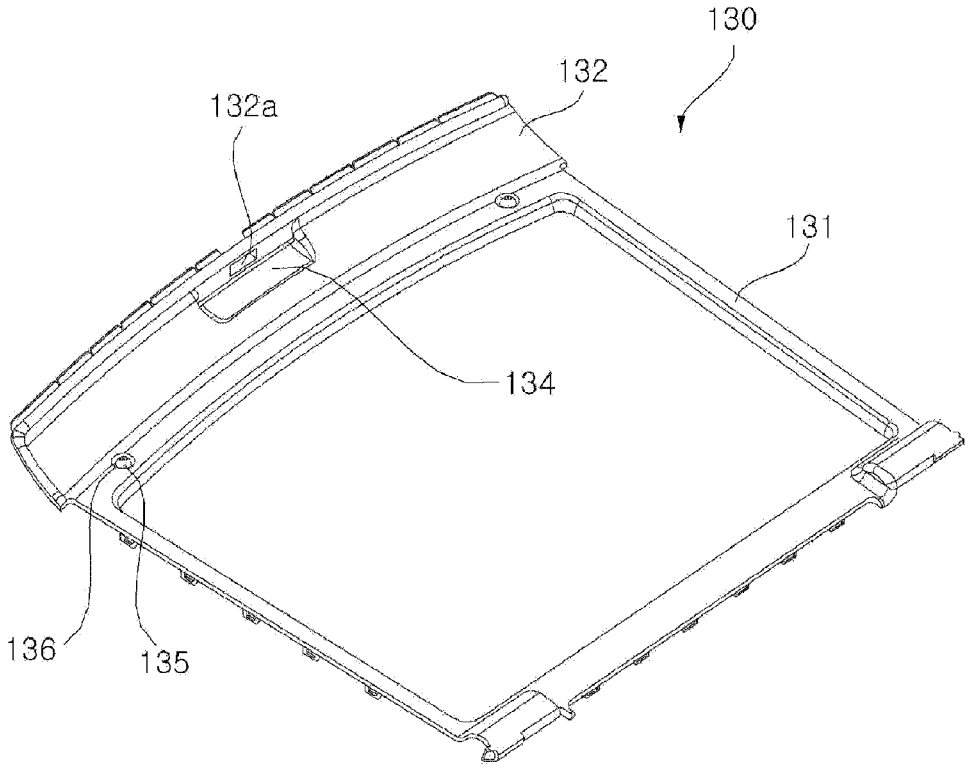
FIG. 14 is a perspective view illustrating the lower surface of the lower lid frame shown in FIG. 13.

FIG. 13 is a perspective view illustrating the lower lid frame shown in FIG. 3, and FIG. 14 is a perspective view illustrating the lower surface of the lower lid frame shown in FIG. 13.

Referring to FIGS. 13 and 14, the lower lid frame 130 includes a frame part 131 which opens at its central portion and a coupling part 132 which extends from a front end of the frame part 131 and is coupled to the upper lid frame 120. The coupling part 132 of the lower lid frame 130 may be formed to be inclined from the frame part 131 by a predetermined angle. The coupling part 132 may include a locking device connecting hole 132*a* for connecting a locking device.

Referring to FIG. 13, the coupling part 132 includes a screw connecting hole 132*b* which corresponds to the screw connecting hole 125 of the upper lid frame 120.

A frame front rib 132*c* protrudes frontward from a lower end of the coupling part 132 to be coupled to the decoration panel 160.

Figure 16:
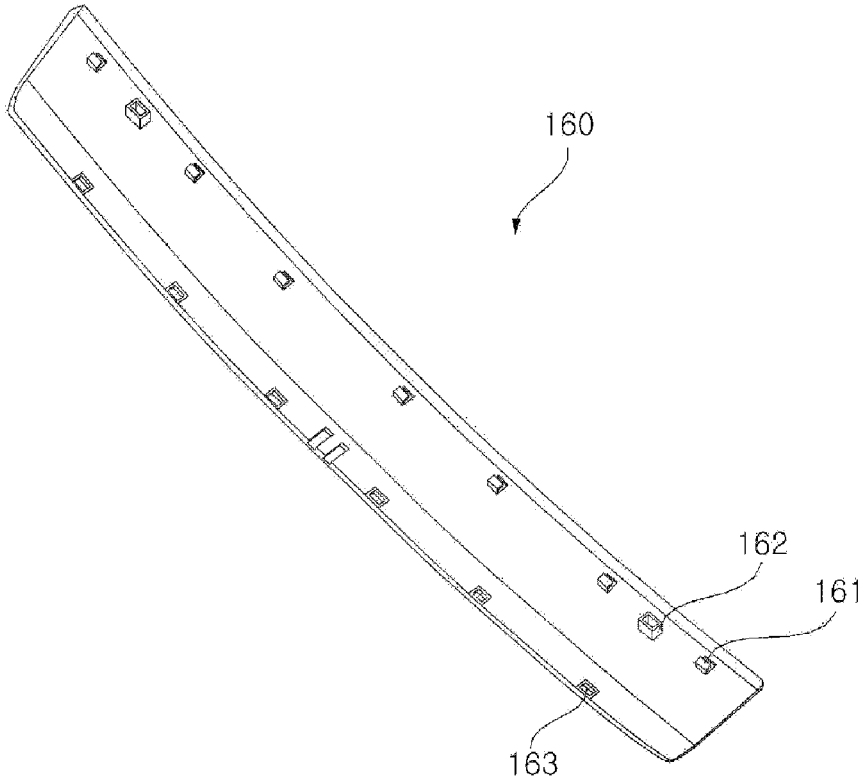
FIG. 16 is a perspective view illustrating a lower surface of the decoration panel shown in FIG. 15.

Specifically, the frame front rib 132*c* is coupled to a lower connecting protrusion 163 as shown in FIG. 16. The lower connecting protrusion 163 will be described below.

The coupling part 132 includes a gap press-fitting part 133 which press-fittingly protrudes in the space between the two adjacent lid inners 140 and pressurizes the lid inners 140 in the direction away from each other so that the lid inners 140 may be brought in tight contact with an inner surface of the lid frame 110.

The gap press-fitting part 133 includes a pair of ribs which protrude upwards from an upper surface of the coupling part 132 and are spaced apart from each other by a predetermined interval.

An inner downward rib coupling part 131*a* is provided on the lower lid frame 130 to be coupled to the inner downward rib 143*b*. The inner downward rib coupling part 131*a* will be described below.

A frame rib 131*b* inserted into the coupling hole 143*c* protrudes from an upper surface of the lower lid frame 130. The frame rib 131*b* may be formed at each of left and right edges and the rear edge of the lower lid frame 130. The frame rib 131*b* includes a protrusion hole 131*c* to which the protrusion 143*d* provided on the coupling hole 143*c* may be inserted.

The front protrusion coupling rib 132*d* is formed on an upper surface of the lower lid frame 130 to be coupled to the inner front protrusion 143*e*. The front protrusion coupling rib 132*d* includes an inserting hole to which the inner front protrusion 143*e* may be inserted in the front and rear directions.

Referring to FIG. 14, the lower lid frame 130 forms the appearance of a lower portion of the lid assembly 100.

The lower lid frame 130 may include a handle groove 134 which allows a user to easily hold the lid assembly. According to an embodiment, a handle which will be described below may be only used without the handle groove 134.

A cushion part connecting hole 136 is formed on a lower surface of the lower lid frame 130 to mount a cushion part 135.

Figure 15:
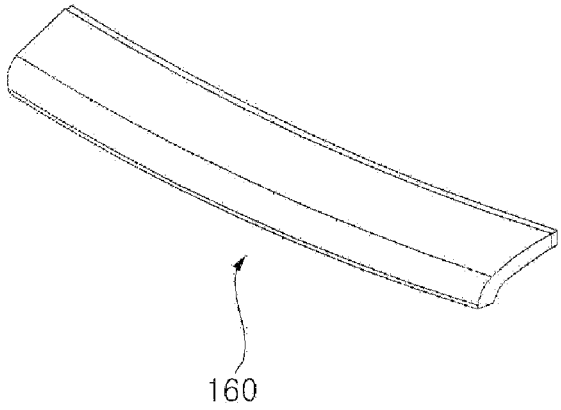
FIG. 15 is a perspective view illustrating the decoration panel shown in FIG. 3.
Figure 17:
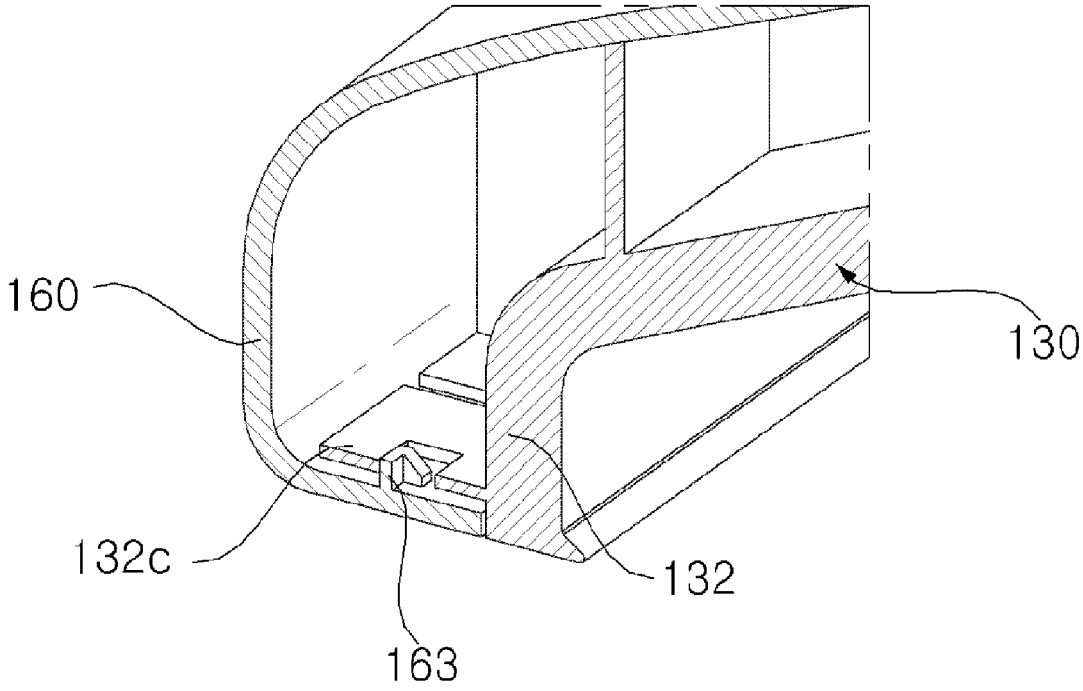
FIG. 17 is a cross sectional view illustrating a combined structure of a decoration panel and a lower lid frame according to an embodiment of the present invention.
Figure 18:
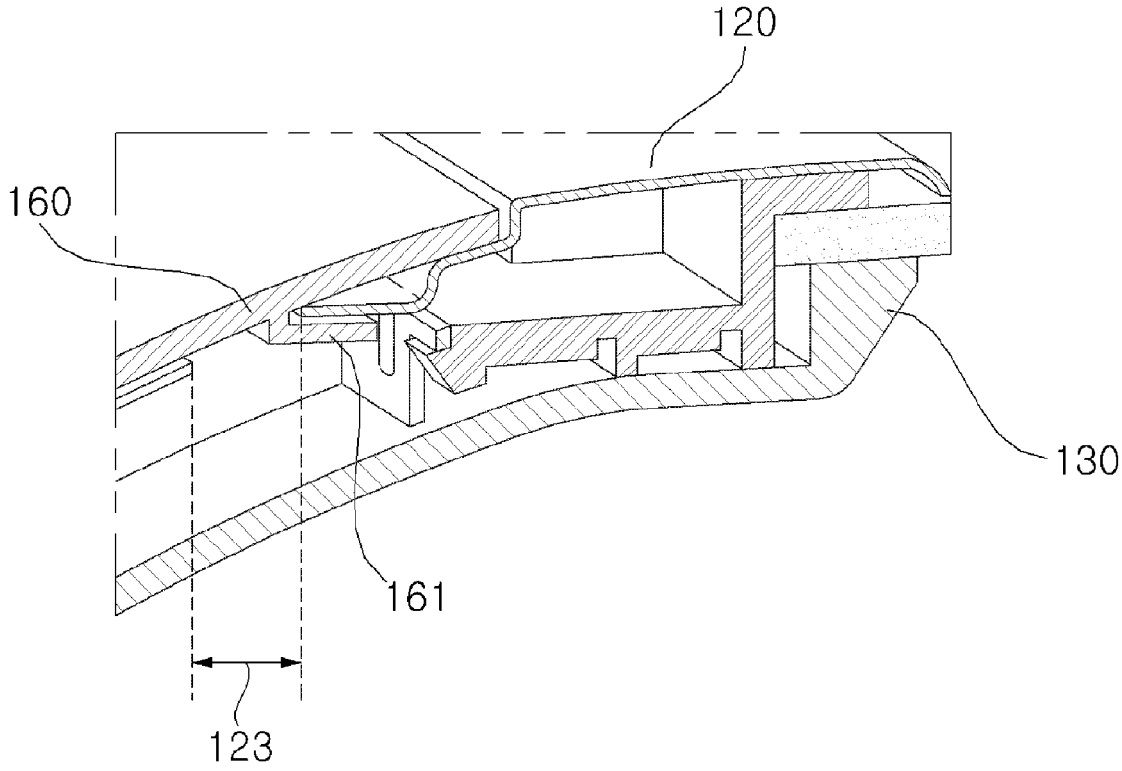
FIG. 18 is a cross sectional view illustrating a combined structure of a decoration panel and an upper lid frame according to an embodiment of the present invention.

FIG. 15 is a perspective view illustrating the decoration panel shown in FIG. 3, FIG. 16 is a perspective view illustrating a lower surface of the decoration panel shown in FIG. 15, FIG. 17 is a cross sectional view illustrating a combined structure of a decoration panel and a lower lid frame according to an embodiment of the present invention, and FIG. 18 is a cross sectional view illustrating a combined structure of a decoration panel and an upper lid frame according to an embodiment of the present invention.

Referring to FIG. 15, an upper part of the decoration panel 160 is slidingly connected to the upper lid frame 120, and a lower part thereof is connected to the lower lid frame 130.

The decoration panel 160 may be formed to be inclined or bent downwards to correspond to a coupling part of the lower lid frame 130.

Referring to FIGS. 16 and 18, a lower connecting protrusion 163 is formed on a lower surface of the decoration panel 160 to be coupled to the frame front rib 132*c* of the lower lid frame 130. The lower connecting protrusion 163 protrudes upwards from an inner lower surface of the decoration panel 160 to be inserted to the lower lid frame 130 in the upper and lower directions. Specifically, the lower connecting protrusion 163 is inserted into the connecting hole formed on the frame front rib 132*c*.

Referring to FIGS. 16 and 17, a plurality of upper connecting protrusions 161 are formed on a lower surface of the decoration panel 160. Each upper connecting protrusion 161 may protrude toward the upper lid frame 120 and then be bent rearwards. For example, the upper connecting protrusion 161 may be shaped as the symbol "┐"The upper connecting protrusion 161 is coupled to the upper connecting protrusion coupling hole 123 formed on the coupling part 122 of the upper lid frame 120.

A plurality of guide protrusions 162 are formed on a lower surface of the decoration panel 160. The guide protrusion 162 is coupled to the guide protrusion coupling hole 124 formed on the coupling part 122 to guide and position the decoration panel 160 upon assembling the decoration panel 160.

Figure 19:
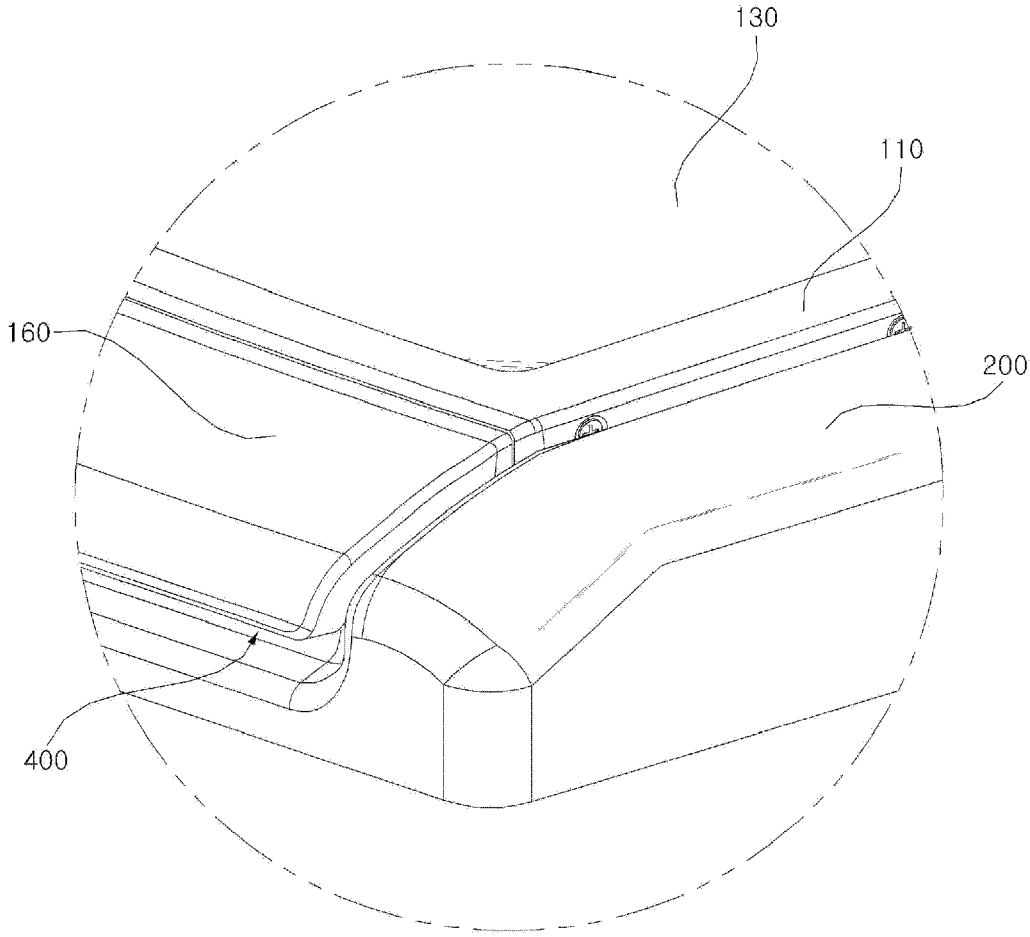
FIG. 19 is an expanded perspective view of part B shown in FIG. 3.
Figure 20:
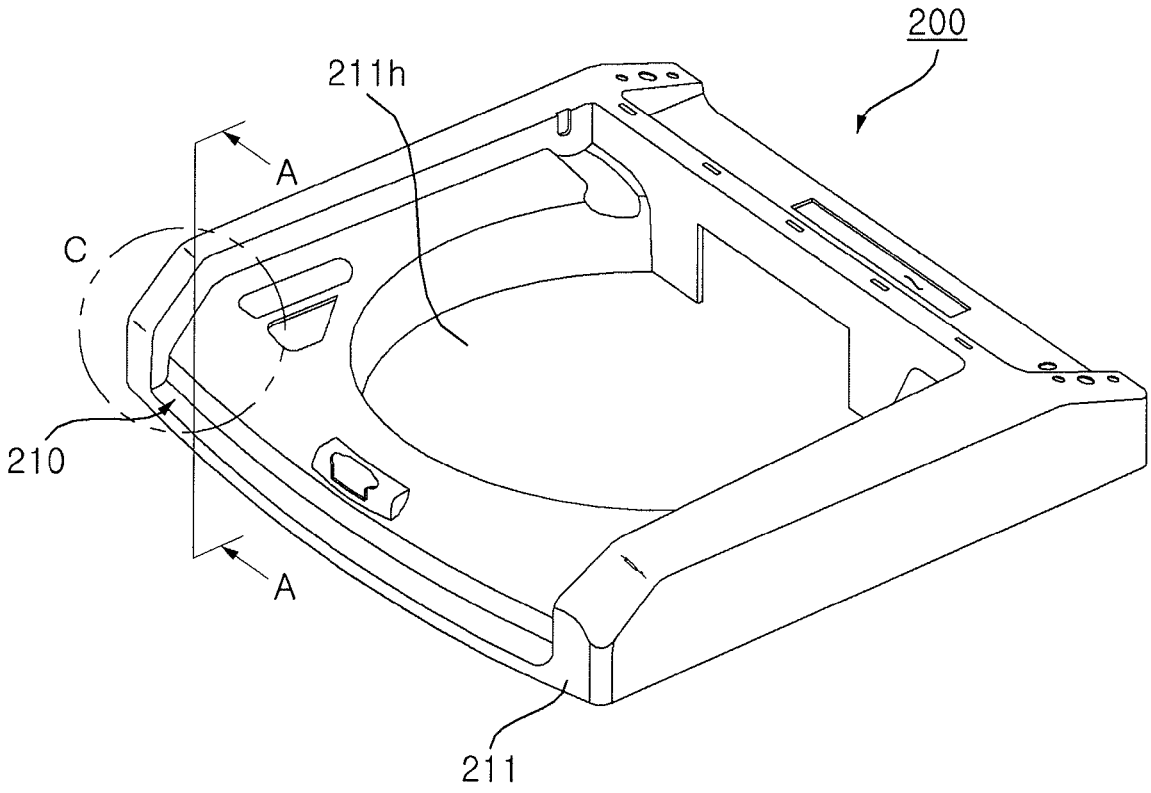
FIG. 20 is a perspective view illustrating the top cover shown in FIG. 3.
Figure 21:
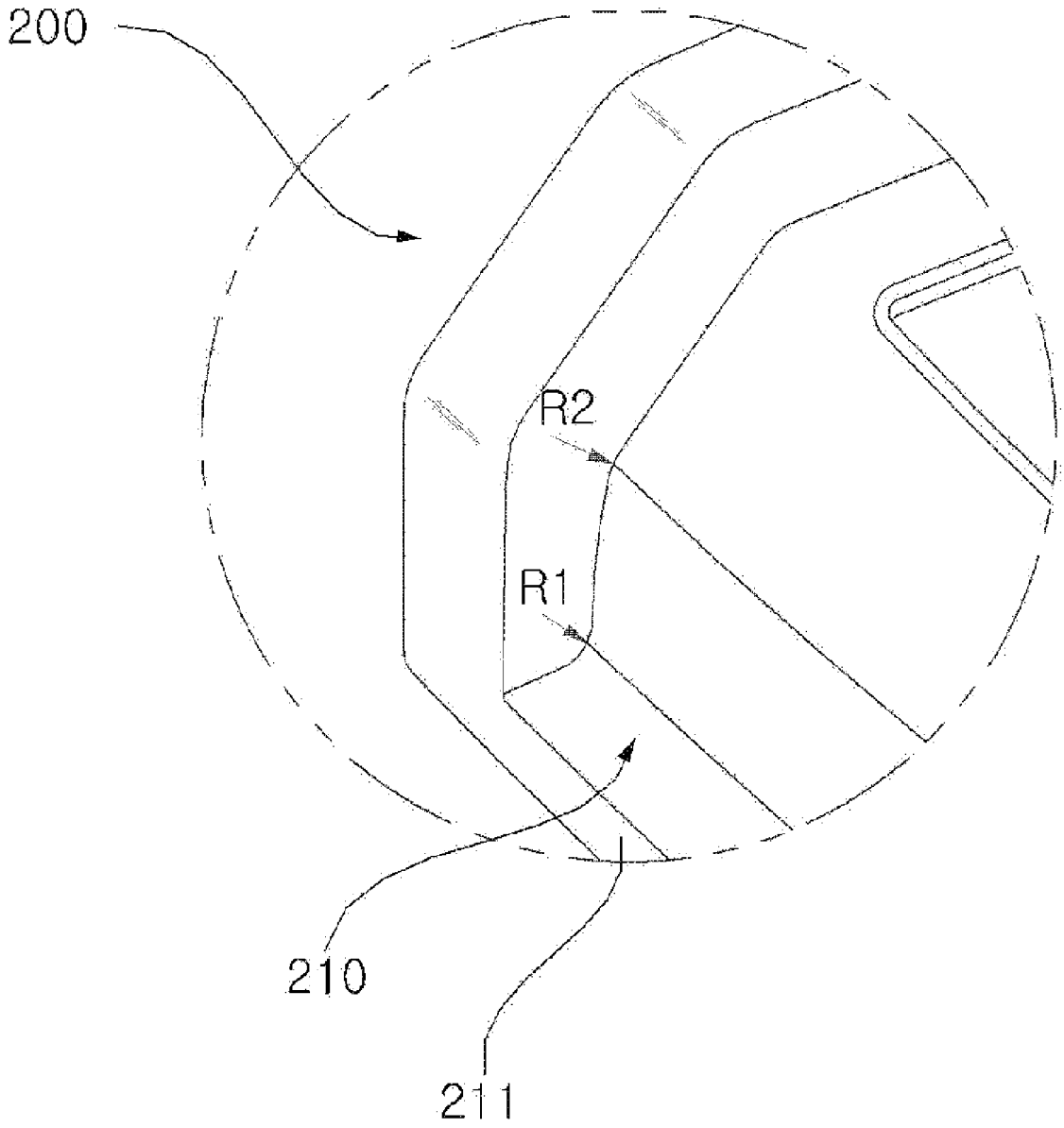
FIG. 21 is an expanded perspective view of part C shown in FIG. 20.
Figure 22:
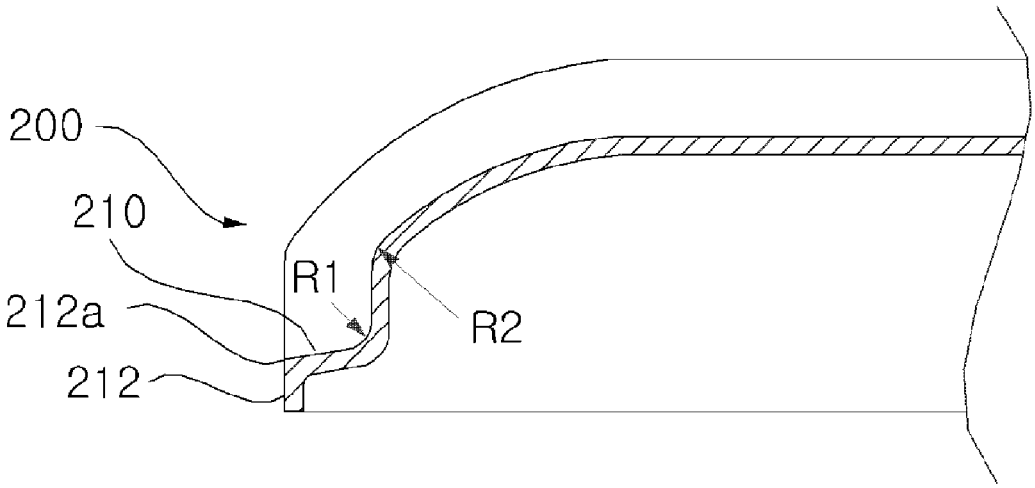
FIG. 22 is a cross sectional view as viewed in the direction of arrow A of FIG. 20.
Figure 23:
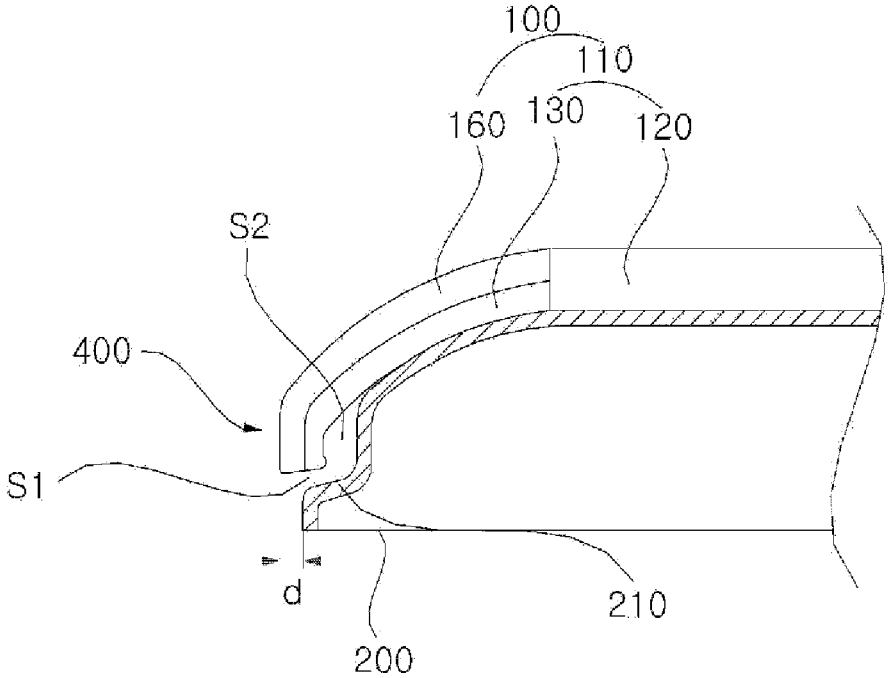
FIG. 23 is a view illustrating a situation where the lid assembly shown in FIG. 22 is closed.
Figure 24:
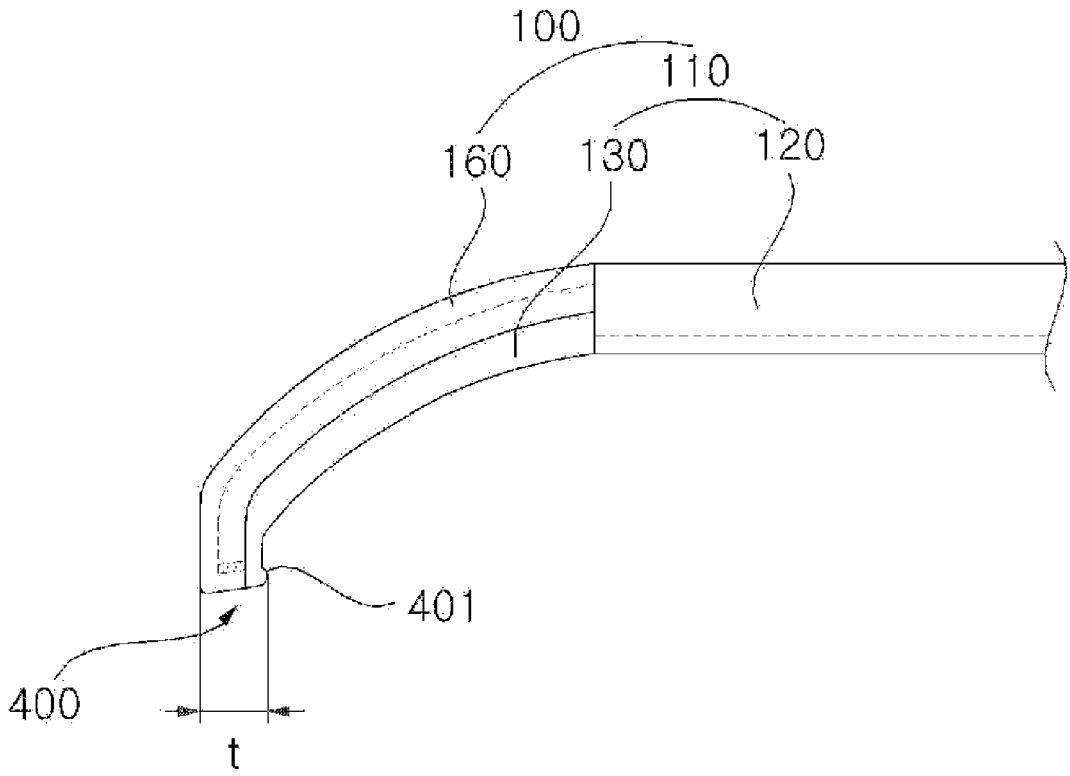
FIG. 24 is a side view illustrating the lid assembly shown in FIG. 23.
Figure 25:
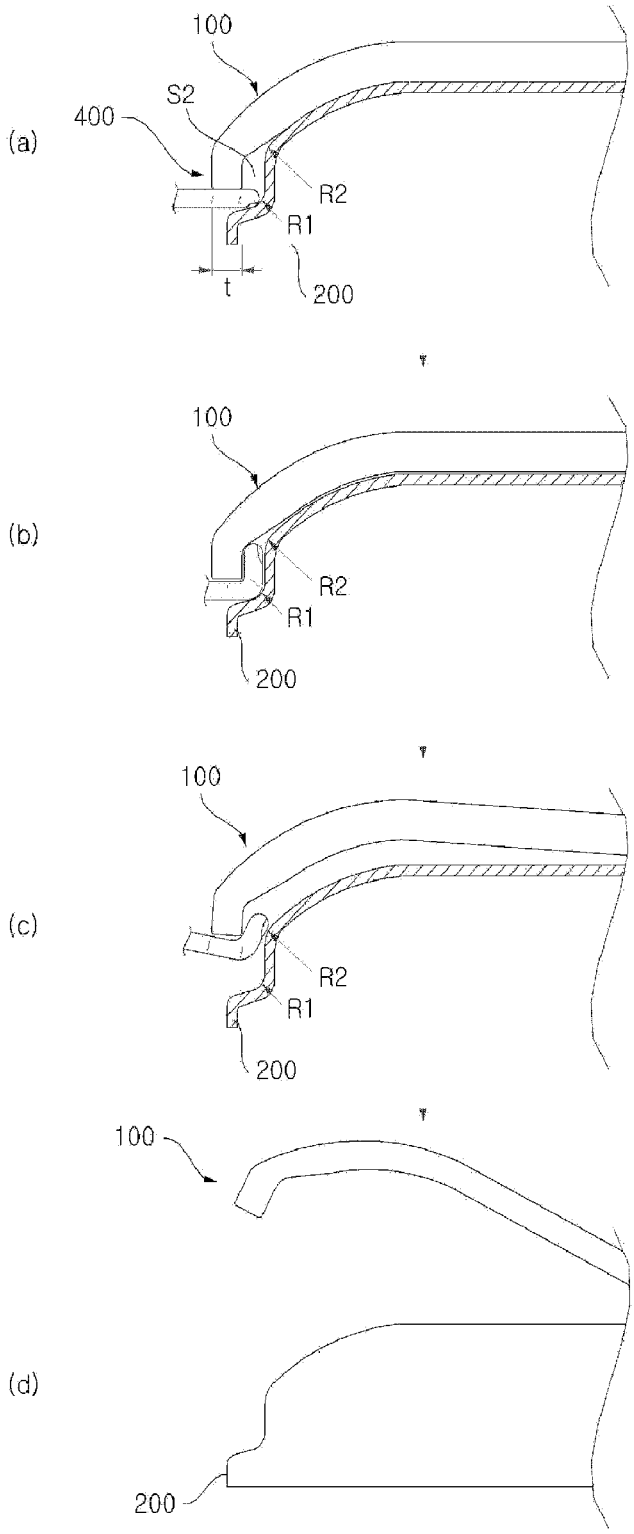
FIG. 25 illustrates a process where a lid assembly is opened by a user's hand.

FIG. 19 is an expanded perspective view of part B shown in FIG. 3, FIG. 20 is a perspective view illustrating the top cover shown in FIG. 3, FIG. 21 is an expanded perspective view of part C shown in FIG. 20, FIG. 22 is a cross sectional view as viewed in the direction of arrow A of FIG. 20, FIG. 23 is a view illustrating a situation where the lid assembly shown in FIG. 22 is closed, FIG. 24 is a side view illustrating the lid assembly shown in FIG. 23, and FIG. 25 illustrates a process where a lid assembly is opened by a user's hand.

Referring to FIGS. 19 to 24, a front end of the lid assembly 100 protrudes forwards more than the top cover 200, thereby defining a handle 400.

The handle 400 may be a lower portion of a combined part that a front portion of the lower lid frame 130 and a front portion of the decoration panel 160 are combined.

Referring to FIG. 23, a front end of the lid assembly 100 is arranged to protrude forwards more than the top cover 200 by a predetermined distance (d) so that a user may easily hold the handle 400.

Referring to FIGS. 23 to 25, the handle 400 and the top cover 200 are spaced apart from each other in the upper and lower directions and in the left and right directions, thereby defining spaces S1 and S2. The spaces S1 and S2 are sized to sufficiently accommodate an adult hand. The space S1 is formed in the upper and lower directions, and the space S2 is formed in the left and right directions.

A user's hand is sequentially inserted into the space S1 and the space S2 so that the user may hold the handle 400 and lift the lid assembly 100.

The spaces S1 and S2 may be formed by a step part 210 provided at a front side of the top cover 200.

Referring to FIGS. 20 to 22, the step part 210 is formed by letting a front end of the top cover 200 spaced apart from the handle 400 by a predetermined interval. Each corner of the step part 210 may be rounded.

Referring to FIG. 22, the step part 210 includes a first rounded portion R1 with a predetermined curvature and a second rounded portion R2 with a predetermined curvature. The first rounded portion R1 faces a user's fingertip inserted to the step part 210 and is bent upwards. The second rounded portion R2 is bent rearwards. Since each corner of the step part 210 is rounded, a user's finger or fingernail is prevented from being damaged when the user's hand is inserted to the spaces S1 and S2 and lifts the lid assembly 100.

Further, a portion 212*a* where a front portion 211 of the top cover 200 and the step part 210 meet each other may also be rounded with a predetermined curvature.

Referring to FIGS. 23 and 25, the handle 400 may be a lower portion of a combined part that the lower lid frame 130 and the decoration panel 160 are combined. The lower portion of the handle 400 may be rounded.

Referring to FIG. 24, a thickness (t) of the lower portion of the handle 400 may be as long as a joint of adult middle finger. For example, the thickness (t) may be in a range from 15 mm to 17 mm. When the thickness (t) is set as above, user's hand may be easily inserted into the spaces S1 and S2.

The lower portion of the handle 400 includes a protrusion 401 which protrudes towards the top cover 200. The protrusion 401 is rounded so that the inserted user's fingers are hanged to the protrusion 401, and this allows the user to easily lift the lid assembly 100.

FIG. 25 illustrates a process where a lid assembly is opened by a user's hand.

As shown in FIG. 25A, a user first inserts his hand in the spaces S1 and S2 between the lid assembly 100 and the top cover 200 when putting or pulling laundry in/out of the washing machine before/after washing. The user's fingers are first inserted in the space S1. In this situation, since the first rounded part R1 is formed to be rounded, the user's fingertips or fingernails are prevented from being damaged.

As shown in FIGS. 25B and 25C, the user's fingers are subsequently inserted into the space S2. At this time, the user may lift the lid assembly 100 with the back of his/her hand contacting the second rounded part R2. Since the second rounded part R2 is formed to be rounded, the user's fingertips or fingernails are prevented from being damaged.

Thereafter, the lid assembly 100 is lifted to be opened as shown in FIG. 25D.

The invention has been explained above with reference to exemplary embodiments. It will be evident to those skilled in the art that various modifications may be made thereto without departing from the broader spirit and scope of the invention. Further, although the invention has been described in the context its implementation in particular environments and for particular applications, those skilled in the art will recognize that the present invention's usefulness is not limited thereto and that the invention can be beneficially utilized in any number of environments and implementations. The foregoing description and drawings are, accordingly, to be regarded in an illustrative rather than a restrictive sense.

What is claimed is:

1. A washing machine comprising:

a cabinet;

a top cover which is arranged at an open top surface of the cabinet and has a laundry entrance hole; and a lid assembly which is arranged at the top cover and opens/closes the laundry entrance hole, wherein the lid assembly comprises:

an upper lid frame in which a first hole is formed;

a lower lid frame coupled to a lower side of the upper lid frame and in which a second hole is formed;

a transparent panel between the upper lid frame and lower lid frame; and a decoration panel coupled to front sides of the upper and lower lid frames;

wherein the decoration panel comprises:

an upper connecting protrusion which is inserted into the first hole in a first direction, movement of the upper connection protrusion in a second direction, which is substantially perpendicular to the first direction, being restricted at a position where the upper connecting protrusion is inserted; and a lower connecting protrusion which extends in the second direction and inserted into the second hole, movement of the lower connecting protrusion being restricted in the first direction.

2. The washing machine of claim 1, wherein the decoration panel covers part of a front upper surface of the upper lid frame.

3. The washing machine of claim 2, wherein a front portion of the upper lid frame is formed to be inclined by a predetermined angle, wherein the decoration panel is formed to be inclined to correspond to the upper lid frame, and wherein a front lower portion of the decoration panel is rounded.

4. The washing machine of claim 2, wherein a lower end of the decoration panel is arranged to be lower than a front end of the lower lid frame to cover the front end of the lower lid frame.

5. The washing machine of claim 1, wherein the upper connecting protrusion extends in the second direction from the decoration panel and then is bent in the first direction.

6. The washing machine of claim 1, wherein the lower connecting protrusion is press-fittingly coupled with the second hole.

7. The washing machine of claim 1, wherein the decoration panel includes a guide protrusion which protrudes towards an upper surface of the upper lid frame and guides an assembling position, and the upper lid frame includes a guide protrusion coupling hole to which the guide protrusion is coupled.

8. The washing machine of claim 1, further comprising:

a handle provided at a front side of the lid assembly and protruding forward more than the top cover;

a first space that is defined between a front portion of the top cover and the handle in the second direction, the first space configured for a user's finger to be inserted; and a second space that is defined between a portion next to the front portion of the top cover and the handle in the first direction.

9. The washing machine of claim 8, wherein the handle is a lower portion of a combined part that a front portion of the lower lid frame and the front portion of the decoration panel are combined.

10. The washing machine of claim 8, wherein a thickness of a lower portion of the handle ranges from 15 mm to 17 mm in the first direction.

11. The washing machine of claim 8, wherein the top cover comprises:

a first rounded part formed between the first and second space with a predetermined curvature; and a second rounded part formed at an end of the second space, the second rounded part having a curvature opposite to the first rounded part.

12. The washing machine of claim 1, wherein the decoration panel slidingly moves along a front upper surface of the upper lid frame and is inserted into the first hole.

13. The washing machine of claim 12, wherein the first hole comprises a portion which has a width narrower than the other portion of the first hole, into which the upper connecting protrusion is inserted.

14. A washing machine comprising:

a top cover having a laundry entrance hole;

a lid assembly arranged to be able to rotate at an upper side of the top cover and opens/closes the laundry entrance hole, wherein the lid assembly comprises:

an upper lid frame forming an upper portion of the lid frame;

a lower lid frame forming a lower portion of the lid frame;

a transparent panel between the upper lid frame and lower lid frame; and a decoration panel comprising:

an upper portion which slides in a first direction and is coupled to a front upper side of the upper lid frame such that a movement in a second direction, which is substantially perpendicular to the first direction, is restricted; and a lower portion coupled to the lower lid frame such that a movement in the first direction is restricted.

* * * * *